US012336640B2

(12) United States Patent
Chen et al.

(10) Patent No.: US 12,336,640 B2
(45) Date of Patent: Jun. 24, 2025

(54) ARMREST-FOLDABLE CHAIR

(71) Applicant: Libin Chen, Changzhou (CN)

(72) Inventors: Libin Chen, Changzhou (CN); Qinglei Kong, Changzhou (CN)

(73) Assignee: Libin Chen, Changzhou (CN)

( * ) Notice: Subject to any disclaimer, the term of this patent is extended or adjusted under 35 U.S.C. 154(b) by 211 days.

(21) Appl. No.: 18/231,257

(22) Filed: Aug. 8, 2023

(65) Prior Publication Data

US 2024/0049882 A1 Feb. 15, 2024

(30) Foreign Application Priority Data

Aug. 13, 2022 (CN) ..... 202222131189.0

(51) Int. Cl.
*A47C 4/28* (2006.01)
*A47C 7/54* (2006.01)

(52) U.S. Cl.
CPC ..... *A47C 4/286* (2013.01); *A47C 7/54* (2013.01)

(58) Field of Classification Search
CPC ..... A47C 4/286
See application file for complete search history.

(56) References Cited

U.S. PATENT DOCUMENTS 6,634,705 B1 * 10/2003 Zheng ..... A47C 4/286 297/45 X
6,926,356 B2 * 8/2005 Chen ..... A47C 4/286 297/45 X
8,100,469 B2 * 1/2012 Lougee ..... A47C 4/44 297/58
8,511,747 B2 * 8/2013 Lougee ..... A47C 9/105 297/58 X
8,864,222 B2 * 10/2014 Grace ..... A47C 1/0265 297/44 X
9,204,729 B2 * 12/2015 Frankel ..... A47C 1/14
9,622,583 B1 * 4/2017 Lv ..... A47C 4/286
10,206,510 B2 * 2/2019 Choi ..... A47C 4/286
10,278,506 B2 * 5/2019 Yang ..... A47C 4/283
10,631,648 B1 * 4/2020 Tsai ..... A47C 4/286
10,758,048 B1 * 9/2020 Tsai ..... A47C 3/00
10,842,279 B2 * 11/2020 Chen ..... A47C 4/286
10,874,217 B2 * 12/2020 Grace ..... A47C 4/286
11,006,755 B2 * 5/2021 Yang ..... A47C 4/00
11,096,493 B1 * 8/2021 Tsai ..... A47C 4/286
12,022,958 B2 * 7/2024 Zhang ..... A47C 4/286
12,053,099 B2 * 8/2024 Choi ..... A47C 4/286
(Continued)

*Primary Examiner* — Rodney B White
(74) *Attorney, Agent, or Firm* — Bayramoglu Law Offices LLC

(57) ABSTRACT

An armrest-foldable chair is provided. The armrest-foldable chair comprises folding mechanisms comprising a main support rod, a front support rod, a rear support rod, a seat rod, a back rod, an armrest rod, an auxiliary rod; a first connection piece slidably connected with the back rod is disposed on the back rod; a second connection piece slidably connected with the front support rod is disposed on the front support rod; a third connection piece slidably connected with the rear support rod is disposed on the rear support rod; and a fourth connection piece slidably connected with the main support rod is disposed on the main support rod. A first end of the auxiliary rod is hinged to the first connection piece, and a second end of the auxiliary rod is hinged to an upper end of the front support rod.

9 Claims, 6 Drawing Sheets

(56) References Cited

U.S. PATENT DOCUMENTS

| | | | | |
|---|---|---|---|---|
| 12,096,860 | B2 * | 9/2024 | Yang | A47C 4/286 |
| 2023/0232984 | A1 * | 7/2023 | Frankel | A47C 4/286<br>297/38 |
| 2024/0188717 | A1 * | 6/2024 | Zhang | A47C 4/286 |

* cited by examiner

ARMREST-FOLDABLE CHAIR

CROSS REFERENCE TO THE RELATED APPLICATIONS

This application is based upon and claims priority to Chinese Patent Application No. 202222131189.0, filed on Aug. 13, 2022, the entire contents of which are incorporated herein by reference.

TECHNICAL FIELD

The present disclosure relates to the field of foldable chair technologies, and in particular to an armrest-foldable chair.

BACKGROUND

Foldable chairs are common outdoor chairs, the core of which is their folding structure. In the prior arts, although the folding structure of the foldable chairs can achieve the purpose of folding and unfolding, the folded structure is not compact but large in volume and height, bringing inconveniences to storage and carriage.

SUMMARY

The present disclosure provides an armrest-foldable chair, which includes two opposed folding mechanisms, and a first linkage mechanism and a second linkage mechanism disposed between the two folding mechanisms. The folding mechanisms include a main support rod, a front support rod, a rear support rod, a seat rod, a back rod, an armrest rod, an auxiliary rod. A first connection piece slidably connected with the back rod is disposed on the back rod; a second connection piece slidably connected with the front support rod is disposed on the front support rod; a third connection piece slidably connected with the rear support rod is disposed on the rear support rod; and a fourth connection piece slidably connected with the main support rod is disposed on the main support rod. A first end of the auxiliary rod is hinged to the first connection piece, and a second end of the auxiliary rod is hinged to an upper end of the front support rod. A lower end of the main support rod is hinged to the second connection piece, and an upper end of the main support rod is hinged to the armrest rod. An end of the armrest rod away from the main support rod is hinged to the back rod. A lower end of the back rod is hinged to the third connection piece. The seat rod is hinged to the fourth connection piece and an end of the seat rod away from the fourth connection piece is hinged to the back rod. The seat rod and the front support rod are crossed and hinged together at the crossing position. The upper end of the rear support rod is hinged to the front support rod. The armrest-foldable chair employs an integral folding structure different from the prior arts, such that the folded structure is more compact, smaller in volume and easy to store and carry.

BRIEF DESCRIPTION OF THE DRAWINGS

The present disclosure will be further described below in combination with drawings and embodiments.

Figure 1:
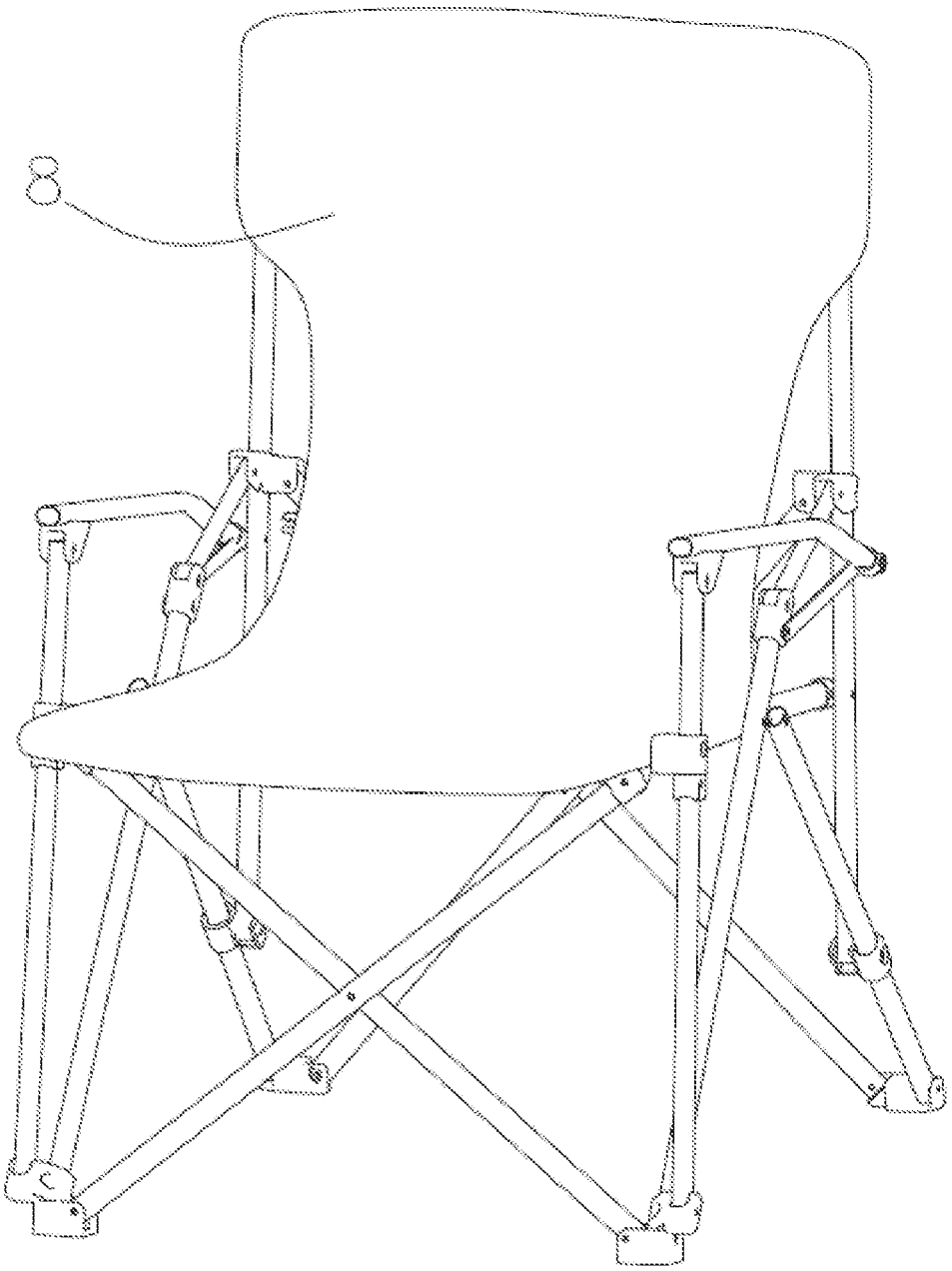
FIG. 1 is a structural schematic diagram illustrating a preferred embodiment of an armrest-foldable chair according to the present disclosure.

In the drawings, the numerals are described below: 1. folding mechanism, 2. first linkage mechanism, 3. second linkage mechanism, 4. first connection piece, 5. second connection piece, 6. third connection piece, 7. fourth connection piece, 8. cushion, 9. locking column, 10. locking buckle, 101. main support rod, 102. front support rod, 103. rear support rod, 104. seat rod, 105. back rod, 106. armrest rod, 107. auxiliary rod, 108. short linkage rod, 109. stop block, 1010. front food pad, 1011. rear food pad, 201. first linkage rod, and 301. second linkage rod.

DETAILED DESCRIPTION OF THE EMBODIMENTS

The embodiments of the present disclosure are detailed below with examples represented in the drawings of the present disclosure. Same or similar numerals represent same or similar elements or elements with same or similar function throughout the specification. The embodiments described by referring to the drawings are only illustrative and used only to interpret the present disclosure rather than to limit the present disclosure.

Figure 2:
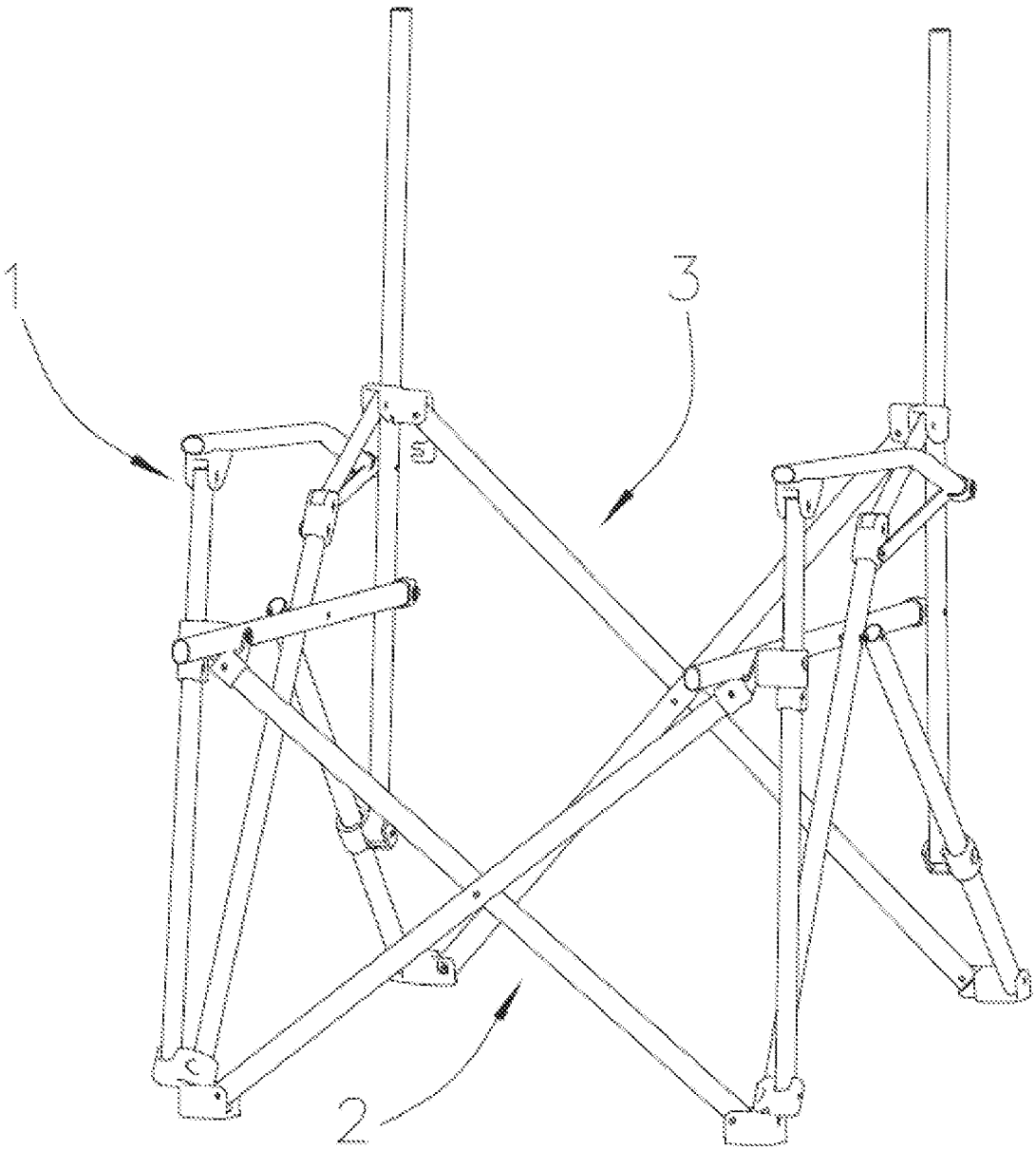
FIG. 2 is a schematic diagram illustrating an unfolding structure of a support part in a preferred embodiment of an armrest-foldable chair according to the present disclosure.
Figure 3:
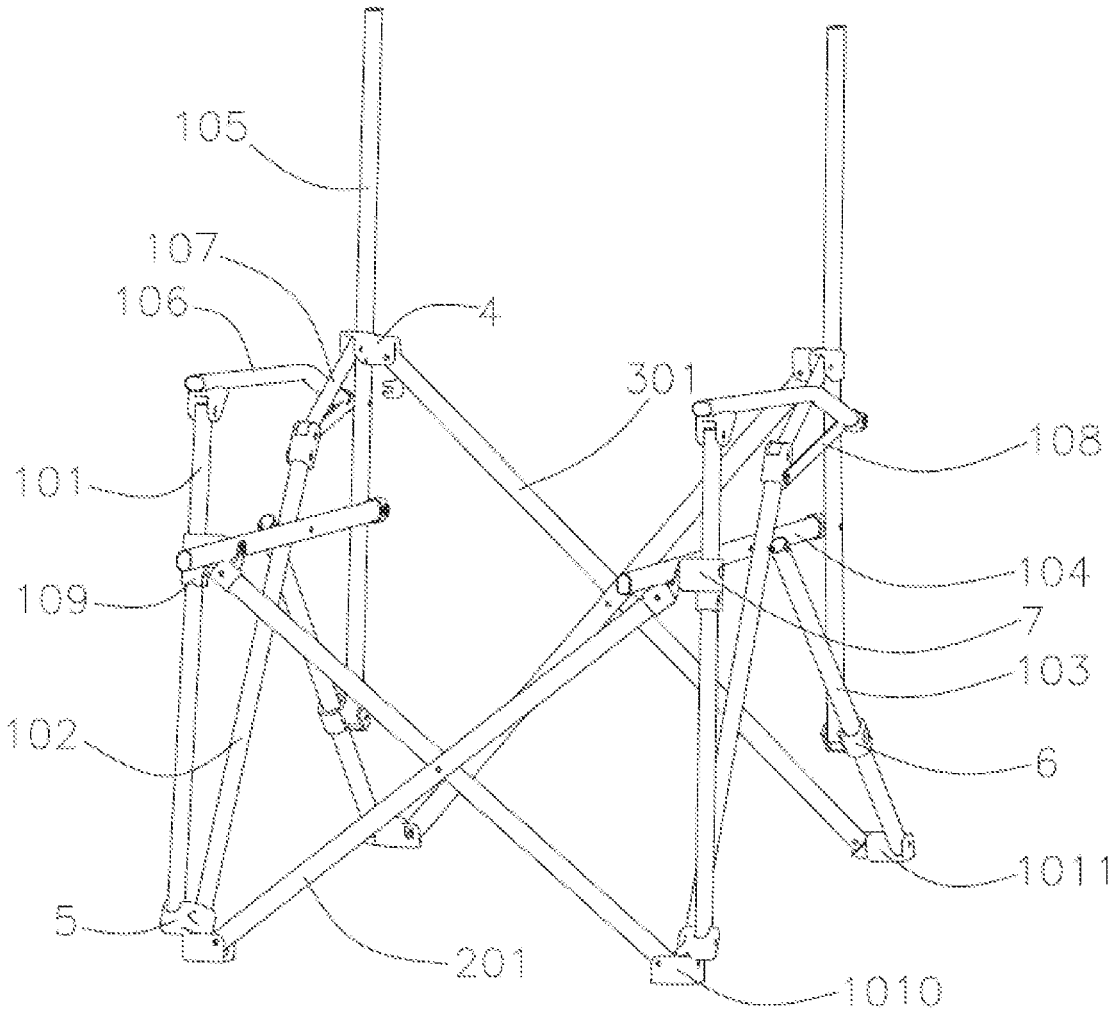
FIG. 3 is a schematic diagram illustrating an unfolding structure of a support part in a preferred embodiment of an armrest-foldable chair according to the present disclosure.
Figure 4:
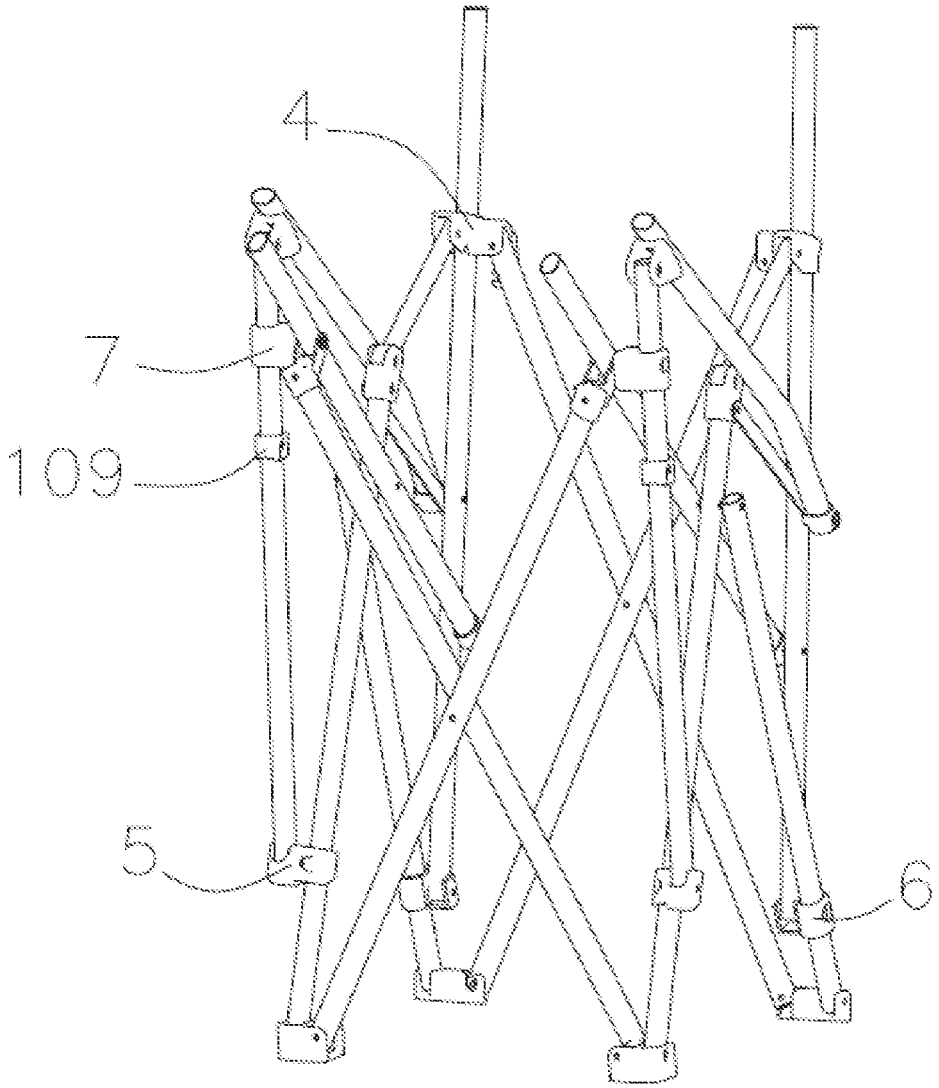
FIG. 4 is a schematic diagram illustrating a semi-folding structure of a support part in a preferred embodiment of an armrest-foldable chair according to the present disclosure.
Figure 5:
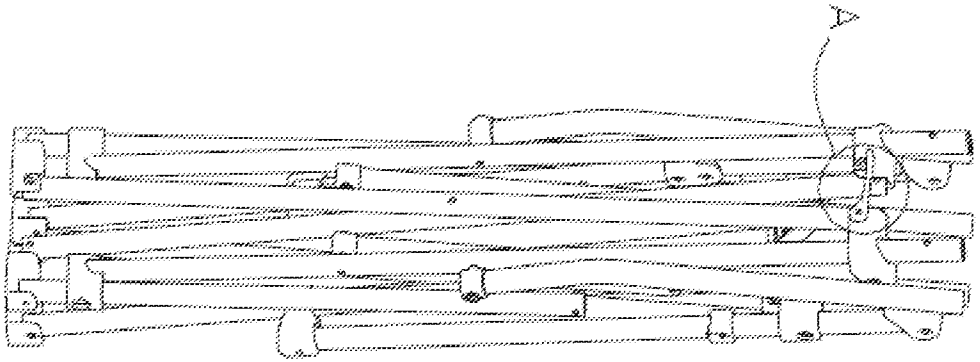
FIG. 5 is a schematic diagram illustrating a semi-folding structure of a support part in a preferred embodiment of an armrest-foldable chair according to the present disclosure.
Figure 6:
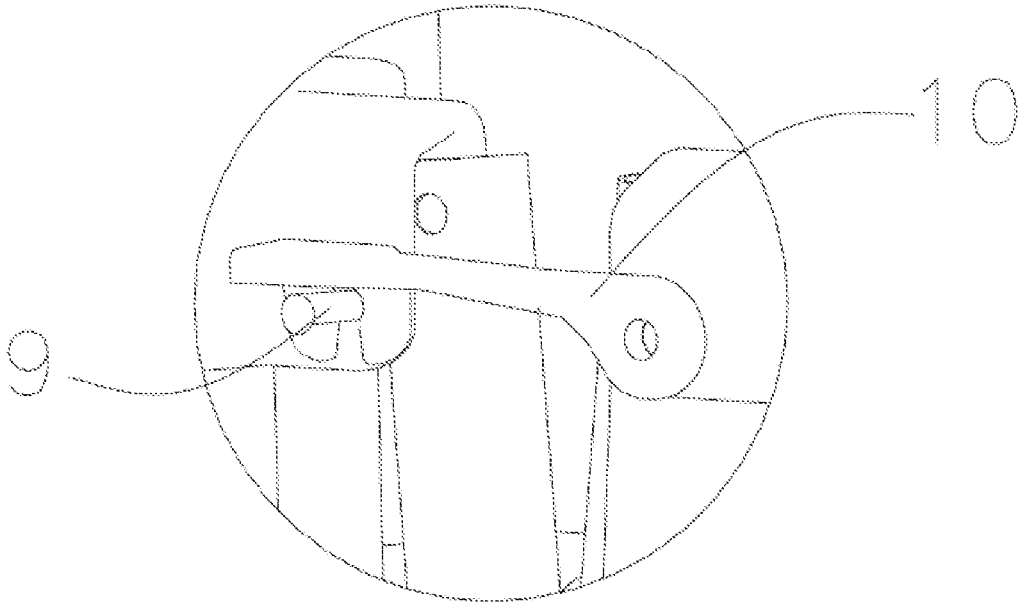
FIG. 6 is an enlarged view of the position A in FIG. 5.

As shown in FIGS. 1 to 6, the present disclosure provides an embodiment of an armrest-foldable chair, which includes two opposed folding mechanisms 1, and a first linkage mechanism 2 and a second linkage mechanism 3 disposed between the two folding mechanisms 1. The folding mechanisms 1 include a main support rod 101, a front support rod 102, a rear support rod 103, a seat rod 104, a back rod 105, an armrest rod 106, an auxiliary rod 107 and a short linkage rod 108.

A first connection piece 4 slidably connected with the back rod 105 is disposed on the back rod 105; a second connection piece 5 slidably connected with the front support rod 102 is disposed on the front support rod 102: a third connection piece 6 slidably connected with the rear support rod 103 is disposed on the rear support rod 103; and a fourth connection piece 7 slidably connected with the main support rod 101 is disposed on the main support rod 101.

A first end of the auxiliary rod 107 is hinged to the first connection piece 4, and a second end of the auxiliary rod 107 is hinged to an upper end of the front support rod 102. A lower end of the main support rod 101 is hinged to the second connection piece 5, and an upper end of the main support rod 101 is hinged to the armrest rod 106. An end of the armrest rod 106 away from the main support rod 101 is hinged to the back rod 105. A lower end of the back rod 105 is hinged to the third connection piece 6. The seat rod 104 is hinged to the fourth connection piece 7 and an end of the seat rod 104 away from the fourth connection piece 7 is hinged to the back rod 105. The seat rod 104 and the front support rod 102 are crossed and hinged together at the crossing position. An upper end of the rear support rod 103 is hinged to the front support rod 102, and both ends of the short linkage rod 108 are hinged to the front support rod 102 and the back rod 105 respectively. The foldable chair further includes a cushion 8 made of a flexible material, for example, a fabric or a plastic. The cushion 8 is fixed to the back rods 105 and the seat rods 104 and thus, can form a backrest and a seat portion when the foldable chair is unfolded. The first linkage mechanism 2 includes two first linkage rods 201 which are crossed and hinged together at the crossing position. Upper ends of the two first linkage rods 201 are hinged to two seat rods 104 respectively and lower ends of the two first linkage rods 201 are hinged to the lower ends of the two front support rods 102 respectively. The second linkage mechanism 3 includes two second linkage rods 301 which are crossed and hinged together at the crossing position. Upper ends of the two second linkage rods 301 are hinged to the two first connection pieces 4 respectively and lower ends of the two second linkage rods 301 are hinged to the lower ends of the two rear support rods 103 respectively.

When the armrest-foldable chair changes from a folded state to an unfolded state, the first connection pieces 4 slide down along the back rods 105, the second connection pieces 5 slides down along the front support rods 102, the third connection pieces 6 slide up along the rear support rods 103, and the fourth connection pieces 7 slide down along the main support rods 101. Since there is a relatively-rotatable hinging relationship between rods, the unfolding effect of the foldable chair can be achieved through changes of angles between rods. The armrest-foldable chair differs from the foldable chair with a conventional structure in that the front support rods 102 and the auxiliary rods 107 are connected among the back rods 105, the main support rods 101 and the first linkage rods 201 and the front support rods 102 are hinged to the auxiliary rods 107. When the foldable chair is in an unfolded state, an angle between the front support rods 102 and the auxiliary rods 107 is small; when the foldable chair is folded, the angle between the front support rods 102 and the auxiliary rods 107 gradually increases until the front support rods 102 and the auxiliary rods 107 are almost in a straight line. In this way, it is guaranteed that the foldable chair has an unfolding amplitude no less than the existing structure upon unfolding, and has smaller volume upon folding.

In this example, a stop block 109 for preventing the fourth connection pieces 7 from sliding down after the foldable chair is unfolded is fixed on the main support rods 101. When the fourth connection pieces 7 reach the stop blocks 109, the fourth connection pieces 7 cannot continue sliding down due to presence of the stop blocks 109. Thus, the foldable chair cannot be further unfolded, such that the foldable chair can be in a stable unfolded state.

The folding mechanisms 1 further include a front foot pad 1010 and a rear foot pad 1011. The lower ends of the front support rods 102 are hinged to the front foot pads 1010 respectively and the lower ends of the rear support rods 103 are hinged to the rear foot pads 1011 respectively. The lower ends of the two first linkage rods 201 are respectively hinged to the two front foot pads 1010, and the lower ends of the two second linkage rods 301 are respectively hinged to the two rear food pads 1011. The front food pads 1010 and the rear food pads 1011 ensure the foldable chair can be stably placed on the ground. Further, like the stop blocks 109, the front food pads 1010 can stop the second connection pieces 5 from sliding down after the foldable chair is unfolded, and hence, the foldable chair cannot be further unfolded.

In this example, the seat rods 104, the front support rods 102 and the rear support rods 103 are hinged together at a same position; the armrest rods 106, the back rods 105 and the short linkage rods 108 are hinged together at a same position. The front support rods 102 have a length about four times that of the auxiliary rods 107.

In this example, the armrest-foldable chair further includes a locking mechanism which includes a locking column 9 and a locking buckle 10 disposed on the two first connection pieces 4 respectively. An end of the locking buckle 10 is hinged to the first connection piece 4 and the other end of the locking buckle 10 has a locking notch for locking the locking column. When the foldable chair is completely folded, the locking buckle 10 is rotated to enable the locking column 9 to be locked in the locking notch of the locking buckle 10. Thus, the two folding mechanisms cannot be separated easily from each other, facilitating storage and carriage. Further, the foldable chair in a folded state has a more compact structure.

Enlightened by the above ideal embodiments of the present disclosure, those skilled in the art can make various changes and modifications based on the above descriptions without departing from the scope of the technical idea of the present disclosure. The technical scope of the present disclosure is not limited to the above contents of the specification but indicated by the scope of the appended claims.

What is claimed is:

1. An armrest-foldable chair, comprising two opposed folding mechanisms, and a first linkage mechanism and a second linkage mechanism disposed between the two opposed folding mechanisms, wherein each of the two opposed folding mechanisms comprise a main support rod, a front support rod, a rear support rod, a seat rod, a back rod, an armrest rod, an auxiliary rod;

a first connection piece slidably connected with the back rod is disposed on the back rod; a second connection piece slidably connected with the front support rod is disposed on the front support rod; a third connection piece slidably connected with the rear support rod is disposed on the rear support rod; and a fourth connection piece slidably connected with the main support rod is disposed on the main support rod;

a first end of the auxiliary rod is hinged to the first connection piece, and a second end of the auxiliary rod is hinged to an upper end of the front support rod; a lower end of the main support rod is hinged to the second connection piece, and an upper end of the main support rod is hinged to the armrest rod, an end of the armrest rod away from the main support rod is hinged to the back rod; a lower end of the back rod is hinged to the third connection piece, the seat rod is hinged to the fourth connection piece and an end of the seat rod away from the fourth connection piece is hinged to the back rod; the seat rod and the front support rod are crossed and hinged together at a crossing position; an upper end of the rear support rod is hinged to the front support rod.

2. The armrest-foldable chair according to claim 1, wherein, each of the two opposed folding mechanisms further comprise a short linkage rod, two ends of the short linkage rod are hinged to the front support rod and the back rod respectively.

3. The armrest-foldable chair according to claim 2, wherein, the first linkage mechanism comprises two first linkage rods, wherein the two first linkage rods are crossed and hinged together at a crossing position, upper ends of the two first linkage rods are hinged to the two seat rods respectively, and lower ends of the two first linkage rods are hinged to lower ends of two front support rods respectively;

the second linkage mechanism comprises two second linkage rods, wherein the two second linkage rods are crossed and hinged together at a crossing position, upper ends of the two second linkage rods are hinged to two first connection pieces respectively and lower ends of the two second linkage rods are hinged to lower ends of two rear support rods respectively.

4. The armrest-foldable chair according to claim 3, wherein, each of the two opposed folding mechanisms further comprise a front foot pad and a rear foot pad;

lower ends of the front support rods are hinged to the front food pads and the lower ends of the rear support rods are hinged to the rear food pads;

the lower ends of the two first linkage rods are hinged to two front foot pads respectively;

the lower ends of the two second linkage rods are hinged to two rear foot pads respectively.

5. The armrest-foldable chair according to claim 4, wherein, a stop block is for preventing the fourth connection pieces from sliding down when the armrest-foldable chair is unfolded, and the stop block is further fixed on the main support rods.

6. The armrest-foldable chair according to claim 5, wherein, the seat rods, the front support rods and the rear support rods are hinged together at a same position.

7. The armrest-foldable chair according to claim 6, wherein, the armrest rods, the back rods and the short linkage rods are hinged together at a same position.

8. The armrest-foldable chair according to claim 7, wherein, a length of the front support rods is 3 to 8 times a length of the auxiliary rods.

9. The armrest-foldable chair according to claim 8, further comprising a locking mechanism, wherein the locking mechanism comprises a locking column and a locking buckle disposed on the two first connection pieces respectively, a first end of the locking buckle is hinged to the first connection piece, and a second end of the locking buckle has a locking notch for locking the locking column.

* * * * *